United States Patent [19]

Brehm

[11] 4,225,065

[45] Sep. 30, 1980

[54] POWDER SPRAYER

[75] Inventor: George L. Brehm, Hilltown, Pa.

[73] Assignee: B & G Equipment Company, Plumsteadville, Pa.

[21] Appl. No.: 9,237

[22] Filed: Feb. 2, 1979

[51] Int. Cl.[3] ..... B05B 11/02

[52] U.S. Cl. ..... 222/631

[58] Field of Search ..... 222/631, 195; 239/320, 239/329, 331, 333

[56] References Cited

U.S. PATENT DOCUMENTS

| | | | |
|---|---|---|---|
| 1,422,253 | 7/1922 | Brown | 222/631 |
| 1,540,198 | 6/1925 | Treadwell | 222/631 |
| 1,777,278 | 9/1930 | Huntington | 222/195 X |
| 1,869,483 | 8/1932 | Knapp et al. | 222/631 |
| 1,877,778 | 9/1932 | Tappan | 222/631 |
| 1,911,972 | 5/1933 | Rose | 222/631 |
| 2,226,013 | 12/1940 | Oys | 222/631 |

*Primary Examiner*—Stanley H. Tollberg

*Attorney, Agent, or Firm*—Zachary T. Wobensmith, 2nd; Zachary T. Wobensmith, III

[57] ABSTRACT

A powder sprayer is described having a barrel or cylinder of synthetic plastic material with an interior baffle cup preferably adhesively secured in the cylinder and closed by a cup closure plate, a check valve being carried therein, the cup bounding a powder chamber and having an air delivery tube, preferably slitted, extending thereinto. The air delivery tube has a threaded end for engagement by a nut rotatable by a manually accessible knob pivotally mounted on an end closure removably sealed to the barrel. The end closure carries a powder delivery tube extending therethrough with its inner end closed and with slits for receiving powder to be delivered through the outer end of the powder delivery tube. The outer end of the powder delivery tube is adapted for attachment of extension tubes and fittings for various types of powder delivery. The powder chamber can be readily refilled by turning the knob and removing the end closure for that purpose. The cylinder at the inlet end has an inlet end collar detachably secured to the cylinder with a hollow tubular piston or plunger also of synthetic plastic material, closed at its inner end and with spaced plates for reception therebetween of a gland or strip packing which serves as an inlet valve.

The cap closure plate and inlet end collar bound a pumping chamber within which the tubular plunger is longitudinally movable.

The tubular plunger provides a space for storage of extension tubes and nozzle tips and has a resilient closure cap frictionally engaged therewith.

9 Claims, 4 Drawing Figures

POWDER SPRAYER

BACKGROUND OF THE INVENTION

1. Field of the Invention

This invention relates to dispensers for tracking powders and insecticides in powdered form.

2. Description of the Prior Art

Various dispensers for powdered materials have heretofore been proposed.

Brown, U.S. Pat. No. 1,422,253, Treadwell, U.S. Pat. No. 1,540,198, Huntington, U.S. Pat. No. 1,777,278, Knapp, U.S. Pat. No. 1,869,483, and Rose, U.S. Pat. No. 1,911,972, show tubular cylinders with pistons of various types and with dispensing nozzles but lack the compactness and simplicity of the structure herein disclosed and would be more difficult to construct and to operate.

Tappan, in U.S. Pat. No. 1,877,778 shows a compressed air duster which is of excessive length.

None of the prior patent disclosures other than Rose and Brown show dispensers which are suited, without modification, for the selective attachment of extensions and different nozzles but these two dispensers have other shortcomings as noted above.

The various dispensers noted above are all made of metal which is subject to corrosion.

None of the dispensers noted above have a simple but effective cylinder and piston structure free from likelihood of corrosion or rusting, with simple but effective and readily accessible provisions for loading a powder chamber, with a hollow tubular piston within the cylinder and with an accessible end portion for manual operation and which can serve as a receptacle for extension tubes and various assorted nozzles.

SUMMARY OF THE INVENTION

In accordance with the invention a dispenser is provided for tracking powders and insecticide dusts which comprises a hollow tubular cylinder with a central baffle having an outlet check valve therein and from which a slitted air delivery tube extends into a powder chamber. The tube has a threaded end for attachment of a removably sealing end closure which also carries a powder delivery tube the inner part of which is slitted, the outer end of the powder delivery tube being adapted for attachment of extension tubes or selected nozzles, the cylinder at the inlet end having an inlet end collar detachably secured to the cylinder and with the cup closure plate bound a pumping chamber, a hollow tubular piston or plunger closed at its inner end being reciprocable in the pumping chamber and with spaced plates for reception therebetween of a gland or strip packing serving as an air inlet valve, the tubular piston or plunger having an interior space for storage of extension tubes and nozzle tips accessible upon removal of a resilient closure cap frictionally engaged with the outer end of the tubular plunger or piston.

It is the principal object of the invention to provide a dispenser for tracking powders and insecticide dusts which is small and easily handled, readily stored in service kits, and which is light in weight and resistant to corrosion.

It is a further object of the invention to provide a dispenser for tracking powders and insecticide dusts which has a relatively large capacity of dust for its size and has a powder chamber which can be readily filled and refilled.

It is a further object of the invention to provide a dispenser for tracking powders and insecticide dusts in which the component parts can be washed if desired and readily replaced, if desired.

It is a further object of the invention to provide a dispenser for tracking powders and insecticide dusts which is particularly suitable for application of powdered materials in hard to reach areas.

It is a further object of the invention to provide a dispenser for tracking powders and insecticide dusts which has provisions for storing within the dispenser extension tubes and nozzle tips for use with the dispenser.

It is a further object of the invention to provide a dispenser for tracking powders and insecticide dusts with which the delivery of dust may be varied by turning the cylinder to vary the orientation of the cylinder.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
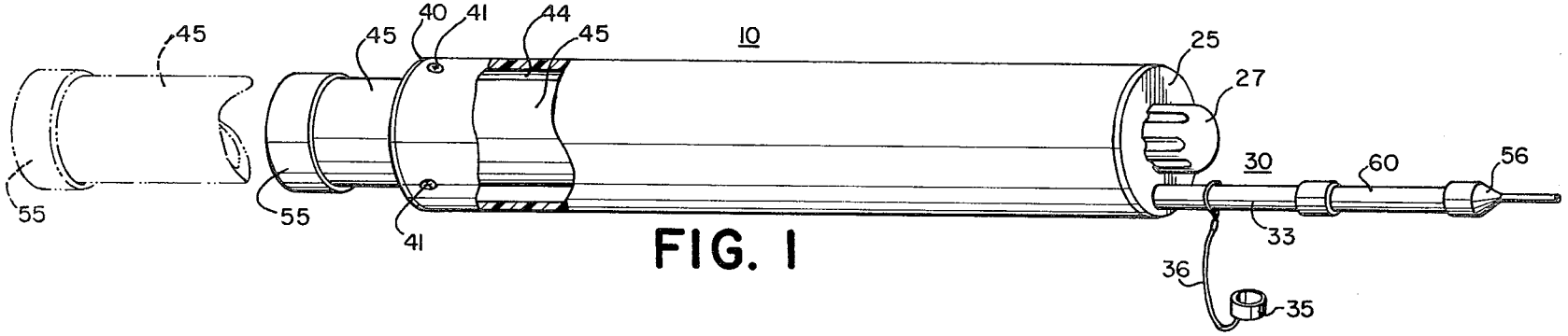
FIG. 1 is an exterior view of the dispenser of the present invention parts being broken away to show the interior.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings the dispenser in accordance with the invention includes a cylindrical tube or cylinder 10 of synthetic plastic material and which in a specific embodiment has a length of the order of eleven and one half inches and an outside diameter of the order of two and one quarter inches. The tube 10 which serves to provide a pumping chamber and a powder chamber, as hereinafter explained, has a cup 11 preferably adhesively secured therein about six inches from one end. The cup 11 has a hollow tube 12 preferably integral therewith communicating with the interior of cup 11 and having a pair of opposite longitudinal air delivery slits 12*a* extending approximately half the length of the tube 12. The tube 12 also has extending from its free end a threaded stud 13. The cup 11 is closed at its open face by a cup cover plate 14 seated on a shoulder 15 which is secured in place in any desired manner such as by a suitable adhesive. The plate 14 has a central opening 17. The cup 11, tube 12 and cover plate 14 are preferably of synthetic plastic material.

Interposed in the cup 11 and retained in place by the plate 14 is an air delivery check valve which preferably comprises a freely movable pad 20 of resilient rubber or the like extending beyond the opening 17 in any position with an associated metallic spacer plate 21 of approximately the same area. The pad 20 is longitudinally axially movable in the cup 11 for covering and uncovering the opening 17. The spacer plate 21 has a plurality of stamped projections 22 to prevent it from closing the end of the slitted tube 12.

An end closure 25 is provided for leak proof engagement in one end of the cylinder 10 and has a nut 26 mounted in a knob 27 for engagement with the threaded stud 13. The knob 27 is exteriorly accessible for removal of the end closure 25. The end closure has a peripheral sealing ring 28 thereon, preferably an O-ring, for sealing engagement with the cylinder 10. The interior space in the tube 10 between the cup 11 and the end closure 25 provides a powder chamber 29 for the powder to be dispensed.

The end closure 25 has a powder delivery tube 30 secured thereto, the interior portion 31 of which is closed at its inner end and provided with opposite longitudinal slits 32 for entry of powder and air for powder delivery. The outer end portion 33 of the tube 30 is adapted for connection of extension tubes or nozzles of desired type, as hereinafter explained.

An end closure cap 35 carried on an elastic cord 36 mounted on the tube portion 33 can be provided for closing the outer end of the tube 30 to prevent escape of powder when the dispenser is not in use.

At the other end of the cylinder 10 a rim 40 is provided which is preferably held in place by screws 41 which extend through openings 42 in the end of the cylinder 10 and into engagement in openings 43 in the rim 40.

A hollow tubular plunger or piston 45 is provided of synthetic plastic material, with spaced circular plates 46 and 47 secured thereto. A pumping chamber 44 is available within the cylinder 10 bounded by the plate 14 and the rim 40 within which the plunger or piston 45 is reciprocable. The inner end of piston 45 is closed by plate 46.

The plate 47 is provided with a plurality of openings 48 for movement of air therethrough and a gland or strip packing 49 of rubber or the like loosely carried between the plates 46 and 47 and engaging the interior of the cylinder 10 provides an air inlet valve.

The rim 40 has an opening 50 therethrough within which is disposed a detent comprising a spring 51 engaged with a ball 52 of nylon, glass or steel, for engagement in an opening 53 in the plunger or piston 45.

The interior of the plunger or piston 45 preferably serves as a storage space for extension tubes and for fittings preferably made of synthetic plastic material to provide the desired powder distribution. The outer end of the piston 45 is closed by a removable flexible synthetic plastic closure 55.

One fitting 56 shown in place on FIG. 1 is identified as a straw tip and dispenses a limited stream of powder.

Figure 3:
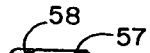
FIG. 3 is a view of one of the extension tubes.
Figure 2:
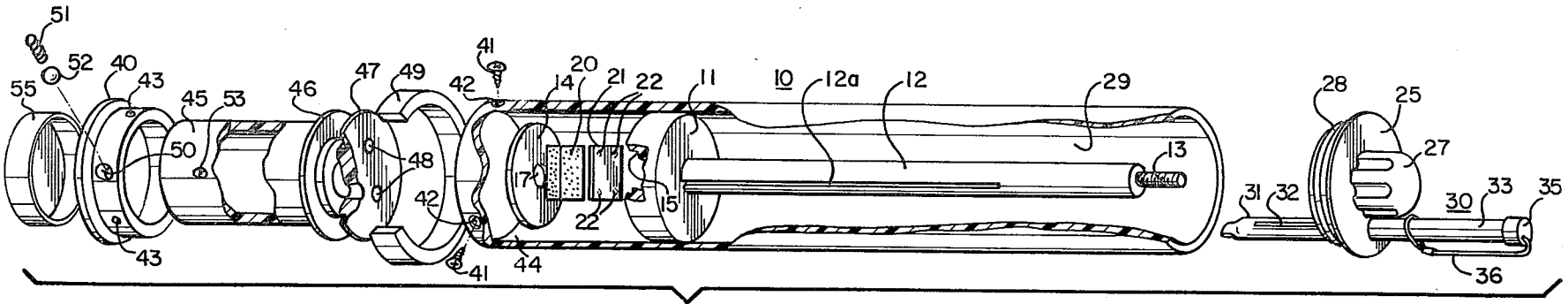
FIG. 2 is an exploded view of the dispenser shown in FIG. 1 and with one type of nozzle tip thereon.

Another fitting 57 shown in FIG. 3 is identified as an offset fan and has a slot 58 which distributes a broad band of powder.

Figure 4:
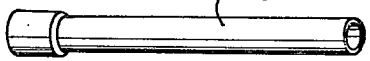
FIG. 4 is a view of another type of nozzle tip which can be employed.

The extension tubes 60 for use on the powder delivery tube are shown in FIGS. 1 and 4.

The mode of use will now be pointed out.

When it is desired to use the powder sprayer the knob 27 is turned to release the end closure 25 and powder to be dispensed is inserted into the powder chamber 29 and the end closure 25 is returned to its initial position and secured by turning the knob 27. The powder can be an insecticide dust for roaches, ants, bees, wasps, yellow jackets and hornets or can be a tracking powder which is applied at a desired location to determine the presence of small rodents, such as rats or mice, by the presence of their footprints.

The desired accessory is mounted on the end portion 33 of the powder delivery tube 30. This may be an extension 60 or extension tubes 60 in series for hard to reach locations. One of the fittings 56 or 57, or other fitting, if desired can be employed either directly on the delivery tube 30 or if desired at the end of an extension tube 60.

The piston or plunger 45 is reciprocated in the cylinder 10 guided by the rim 40, limited in its inward movement by the cup cover plate 14 and in its outward movement by engagement of the plate 46 with the rim 40.

As the piston or plunger 45 is moved outwardly air can enter from the pumping chamber 44 to facilitate outward movement. The loose fit between the plunger or piston 45 and the rim 40 also facilitates outward movement and entry of air into the pumping chamber 44.

Upon inward movement of the plunger or piston 45 the pressure tending to build up in the pumping chamber 44 forces the packing 49 outwardly into a sealing position, and air is delivered past the pad 20, into the tube 12 in the powder chamber 20 to agitate the powder therein for delivery of powder entrained in air through the perforations 32 in the powder delivery tube 30 for discharge through the outer end portion 33 of the tube 30.

The nature of the discharge of the powder and the location to which it is delivered will be determined by the accessories employed on the outer end portions of the delivery tube 30.

The volume of powder delivered can be varied or adjusted by partial rotation of the cylinder 10 to change the relative position of the delivery tube 30 with respect to the knob 27.

The detent comprising the spring pressed ball 52 carried by the rim 40 and engageable in the opening 53 prevents accidental dislodgment of the piston or plunger 45 and retains it at a position for storage.

I claim:

1. A dispenser for powder comprising a cylinder of non-corrosive material having a delivery end and a plunger receiving end and transverse members intermediate said ends providing a valve chamber with an air delivery valve member therein, one of said transverse members having a tube with openings therethrough extending therefrom within said cylinder and toward the delivery end of said cylinder, a rim at the plunger receiving end of said cylinder mounted in said cylinder providing an abutment, a removable end closure for said delivery end of said cylinder having a powder delivery tube extending therethrough, the space within said cylinder between said transverse members and said end closure constituting a powder chamber, a hollow reciprocable plunger of non-corrosive material and of lesser diameter than said cylinder closed at its inner end and extending inwardly at the plunger receiving end of said cylinder and outwardly therebeyond and being slidable in said rim, and air inlet valve means carried by said plunger and limiting the outward movement of said plunger by engagement with said rim.

2. A dispenser as defined in claim 1 which said air delivery valve member includes spaced plates one of which has an opening therethrough and a pad movable with respect to said opening to provide said air delivery valve member.

3. A dispenser as defined in claim 1 in which said removable end closure has an exteriorly disposed member thereon for engagement with a member carried by said tube for retaining said removable end closure in closed position.

4. A dispenser as defined in claim 3 in which said last mentioned members are in threaded engagement.

5. A dispenser as defined in claim 1 in which said powder delivery tube has an interiorly disposed perforated portion and an exteriorly disposed portion for attachment of an accessory.

6. A dispenser as defined in claim 5 in which said accessory is an extension tube.

7. A dispenser as defined in claim 5 in which said accessory has a delivery portion of reduced diameter.

8. A dispenser as defined in claim 5 in which said accessory has a slotted portion for wide band delivery of powder.

9. A dispenser as defined in claim 1 in which said plunger has an open outer end for accessory insertion and storage, and a closure cap is provided for retaining accessories within said plunger.

* * * * *